US007570773B2

(12) United States Patent
Ohbayashi et al.

(10) Patent No.: US 7,570,773 B2
(45) Date of Patent: Aug. 4, 2009

(54) SOUND DETECTING MECHANISM

(75) Inventors: Yoshiaki Ohbayashi, Nara (JP); Mamoru Yasuda, Kobe (JP); Shinichi Saeki, Kashiwara (JP); Masatsugu Komai, Nishinomiya (JP); Kenichi Kagawa, Kawasaki (JP)

(73) Assignees: Hosiden Corporation, Osaka (JP); Tokyo Electron Limited, Tokyo (JP)

( * ) Notice: Subject to any disclaimer, the term of this patent is extended or adjusted under 35 U.S.C. 154(b) by 502 days.

(21) Appl. No.: 10/565,059

(22) PCT Filed: Jul. 14, 2004

(86) PCT No.: PCT/JP2004/010042

§ 371 (c)(1),
(2), (4) Date: Jan. 17, 2006

(87) PCT Pub. No.: WO2005/009077

PCT Pub. Date: Jan. 27, 2005

(65) Prior Publication Data

US 2006/0233400 A1 Oct. 19, 2006

(30) Foreign Application Priority Data

Jul. 17, 2003 (JP) ..... 2003-276009

(51) Int. Cl.
*H04R 25/00* (2006.01)

(52) U.S. Cl. ..... 381/175; 381/174

(58) Field of Classification Search ..... 381/113, 381/116, 174, 175, 190, 191, 369; 367/140, 367/170, 181; 310/322, 324
See application file for complete search history.

(56) References Cited

U.S. PATENT DOCUMENTS

| | | | | |
|---|---|---|---|---|
| 6,140,689 | A | 10/2000 | Scheiter et al. | |
| 6,243,474 | B1 * | 6/2001 | Tai et al. | 381/174 |
| 6,870,939 | B2 * | 3/2005 | Chiang et al. | 381/175 |

FOREIGN PATENT DOCUMENTS

| | | | |
|---|---|---|---|
| JP | 7-50899 | A1 | 2/1995 |
| JP | 8-95572 | A | 4/1996 |
| JP | 2002-95093 | A | 3/2002 |
| JP | 2002-209298 | A | 7/2002 |
| JP | 2002-223499 | A | 8/2002 |
| JP | 2003-163996 | A | 6/2003 |
| JP | 2003-163998 | A | 6/2003 |

* cited by examiner

*Primary Examiner*—Brian Ensey
(74) *Attorney, Agent, or Firm*—The Webb Law Firm

(57) ABSTRACT

A sound detecting mechanism capable of forming a diaphragm and a back electrode on a substrate by a simple process includes acoustic holes corresponding to perforations formed on a front surface of a substrate. A second protective film, a sacrificial layer and a metal film are laminated on the front surface in a portion corresponding to the acoustic holes. The substrate is etched from the back surface thereof to a depth reaching the acoustic holes to form an acoustic opening. Subsequently, by effecting an etching from the back surface of the substrate through the acoustic holes, the sacrificial layer is removed and a void area is formed between the diaphragm made of the metal film, the substrate and the formed perforations. The sacrificial layer that remains after the etching is used as a spacer for maintaining a gap between the back electrode and the diaphragm.

4 Claims, 6 Drawing Sheets

A: substrate
B: back electrode
Ba: perforations (acoustic holes)
C: diaphragm
D: spacer
E: acoustic opening
F: void area 401: silicon substrate
404: electrode portion
406: second protective film
407: sacrificial layer
408: metal film A: substrate B: back electrode Ba: perforations (acoustic holes)

C: diaphragm

D: spacer

E: acoustic opening

F: void area

401: silicon substrate

404: electrode portion

406: second protective film

407: sacrificial layer

408: metal film relationship between phosphours content and internal stress

A: substrate

B: back electrode

Ba: perforations (acoustic holes)

C: diaphragm

D: spacer

E: acoustic opening

F: void area

401: silicon substrate

404: electrode portion

406: second protective film

407: sacrificial layer

408: metal film

420: base layer

A: substrate

B: back electrode

Ba: perforations (acoustic holes)

C: diaphragm

D: spacer

E: acoustic opening

F: void area

G: integrated circuit

H: wiring

401: silicon substrate

406: second protective film

407: sacrificial layer

408: metal film

SOUND DETECTING MECHANISM

TECHNICAL FIELD

The present invention relates to a sound detecting mechanism comprising a pair of electrodes forming a capacitor on a substrate in which one of the electrodes is a back electrode forming perforations therein corresponding to acoustic holes and the other of the electrodes is a diaphragm. More particularly, the invention relates to a sound detecting mechanism used as a sensor or microphone for measuring sound pressure signals.

BACKGROUND ART

Conventionally, condenser microphones are frequently used in mobile phones, for example. A typical construction of condenser microphones is shown in FIG. 7. This condenser microphone comprises a metal capsule 100 including a plurality of perforations "h" corresponding to acoustic holes formed therein, a fixed electrode 300 and a diaphragm 500 provided inside the capsule to be opposed to each other with a spacer 400 therebetween to maintain a predetermined gap, a substrate 600 fixed and fitted to a rear opening of the capsule 100, and an impedance converting element 700 made of J-FET or the like and mounted to the substrate 600. With this type of condenser microphone, a high voltage is applied to a dielectric material formed on the fixed electrode 300 or the diaphragm 500 to be heated to generate electric polarization and produce an electret membrane allowing a residual electric charge to remain on a surface thereof (an electret membrane 510 is formed in a diaphragm body 520 made of metal or conductive film which constitutes the diaphragm 500 in FIG. 7), thereby to provide a construction that requires no bias voltage. When the diaphragm 500 is vibrated by sound pressure signals of a sound, a distance between the diaphragm 500 and the fixed electrode 300 is changed to vary capacitance. The variation of capacitance is outputted through the impedance converting element 700.

A technique for miniaturizing the condenser microphone is known from Patent Document 1 listed below, for example. With this technique, an oxide layer (2), polycrystal silicon layers (3) and (5), a silicon nitride layer (4) and a sacrificial layer made of polycrystal silicon are formed on a silicon wafer (1), and a diaphragm (silicon nitride layer (4)) is formed on the silicon wafer by etching or the like. A back plate having numerous perforations (30) corresponding to acoustic holes and acting as a back electrode is formed on the same silicon wafer (1) by the same technique for forming the diaphragm. The diaphragm and the back plate are superimposed and combined to each other using the technique of eutectic soldering, capacitive coupling, silicon fusion or the like to constitute a unit acting as the microphone (the reference numerals are derived from the reference document).

Further, a technique for miniaturizing the condenser microphone is also known from Patent Document 2 listed below, for example. This technique comprises a first step for forming a mask for forming a recess and doping boron for forming a diaphragm on the back side of a monocrystal silicon substrate (101), a second step for forming a mask for doping boron for forming a back plate on the front surface of the monocrystal silicon substrate, a third step for doping a predetermined amount of boron from the front surface and the back surface of the monocrystal silicon substrate, and a fourth step for forming acoustic holes by dry etching, forming a gap between the back plate and the diaphragm by alkali etching and finally forming an electrode, thereby to complete the microphone. With this technique, the diaphragm (102) and the back plate (103) corresponding to a back electrode are integrally formed with the substrate (101) (the reference numerals are derived from the reference document).

A similar technique is also known from Patent Document 3 listed below, for example. With this technique, a bulk silicon layer (1), an insulating layer (2) and a body silicon layer (3) are laminated. A doping area (8) formed on the body silicon layer (3) is used as a back electrode, and a plurality of openings (10) corresponding to acoustic holes are formed on the doping area (8). A membrane (7) consisting of a membrane layer (5) formed in a position opposed to the doping area (8) through a spacer (4) (sacrificial layer) is used as a diaphragm. With this technique, as with the technique described in Patent Document 2, hollows (9) are formed in the body silicon layer (3) to form the openings (10), and a void (6) is formed between the doping area (8) and the membrane (7) by processes such as mask forming, doping, etching and the like (the reference numerals are derived from the reference document).

Patent Document 1: Patent Publication No. 7-50899
Patent Document 2: Patent Publication No. 2002-95093
Patent Document 3: U.S. Pat. No. 6,140,689

DISCLOSURE OF THE INVENTION

Problems to be SOLVED by The Invention

In order to increase output (improve sensitivity) of the conventional microphone shown in FIG. 7, it is required to increase the capacitance between the fixed electrode 300 and the diaphragm 500. In order to increase the capacitance, an area of superimposition of the fixed electrode 300 and the diaphragm 500 should be increased. Alternatively, it will be effective to reduce the gap between the fixed electrode 300 and the diaphragm 500. However, an increase in the area of superimposition of the fixed electrode 300 and the diaphragm 500 would lead to enlargement of the microphone per se. On the other hand, in the construction having the spacer 400 noted above, there is a limitation in reducing the distance between the fixed electrode 300 and the diaphragm 500.

The electret condenser microphones often utilize a high polymeric organic substance such as FEP (Fluoro Ethylene Propylene) or the like in order to produce a permanent electric polarization. The microphone using such a high polymeric organic substance has poor heat resistance, and thus is hardly capable of enduring the heat in time of reflow treatment when mounted on a printed board, for example. The microphone, therefore, cannot be given reflow treatment when mounted on the printed board or the like.

In view of the above, as described in Patent Documents 1, 2 and 3, it is conceivable to form a back electrode and a diaphragm on a silicon substrate to reduce the distance between the fixed electrode and the diaphragm thereby to increase output. With such a construction, the sound detecting mechanism can undergo reflow treatment while requiring a bias supply since an electret film is not formed.

However, according to the technique disclosed in Patent Document 1, it is required to form the diaphragm on the silicon substrate, form the back plate on the same silicon substrate, and superimpose the diaphragm and the back plate to be combined by the technique of eutectic soldering, capacitive coupling, silicon fusion or the like, which inevitably lowers yield. Moreover, the accuracy of the gap distance between the diaphragm and the back electrode tends to be lowered, which leaves room for improvement in reliability.

According to the technique disclosed in Patent Document 2, the thickness of the back electrode is determined by the amount of ion implantation in time of boron doping, i.e. by the energy generated in time of ion implantation. Thus, the thickness of the back electrode is determined only within a range of adjustment of this energy, which disadvantageously lowers the degree of design choice.

According to the technique disclosed in Patent Document 3, the silicon substrate with the SOI layer is used as the back electrode, which can overcome the disadvantage of the limited thickness of the back electrode as seen in Patent Document 2, and solve the problem of stress control for the back electrode. Moreover, the back electrode is advantageously formed integrally with a signal processing circuit such as a J-FET. However, with the technique disclosed in Patent Document 3, since the oxide film is used as the sacrificial layer and an HF etching liquid is used as a material for etching the sacrificial layer, it is necessary to select a material having HF resistance to be used in an electrode pad and a circuit protective film for the construction having the circuit formed in unison therewith. Also, with the technique disclosed in Patent Document 3, the thickness accuracy for the back electrode is ensured by using the SIO-layer silicon substrate as the back electrode, which requires SOI to be used as the substrate and inevitably increases cost.

The object of the invention is to provide a rational construction for a sound detecting mechanism capable of forming a diaphragm and a back electrode on a substrate by a simple process and easily controlling the stress of the back electrode, as well as forming the back electrode with high accuracy without using any expensive wafer such as SOI.

Means for Solving The Problem

The characteristic feature of the present invention lies in a sound detecting mechanism comprising a pair of electrodes forming a capacitor on a substrate in which one of the electrodes is a back electrode forming perforations therein corresponding to acoustic holes and the other of the electrodes is a diaphragm, characterized in that the diaphragm is made of a metal film or a laminated film, the metal film being formed by sputtering in a low temperature process, vacuum vapor deposition or plating technique, the laminated film being formed of an organic film(s) and a conductive film(s), that the back electrode is formed on the substrate, and that a spacer is formed from part of a sacrificial layer consisting of an organic film for determining a distance between the diaphragm and the back electrode.

According to this construction, the sacrificial layer is formed of the organic film and thus an organic film remover and a plasma treatment are used as materials for etching the sacrificial layer. Therefore, the process can be executed without damaging the diaphragm and the back electrode, which is suitable for integration of a circuit. Since the organic film is used for the sacrificial layer, which allows the process is executed at low temperature, the thickness is easily varied, and the controllability of the thickness is improved. As a result, the manufacturing process can be simplified to provide the sound detecting mechanism capable of detecting sound pressure signals with high sensitivity. Particularly, the sound detecting mechanism having this construction does not form any electret layer, and thus is capable of enduring high temperature in time of reflow treatment.

According to the present invention, the diaphragm may be made of an Ni film or Cu film formed by plating technique, and inner stress of the diaphragm may be determined by setting processing conditions in executing the plating process.

With this construction, since the diaphragm is formed by plating technique, a relatively thick diaphragm can be formed in a short period of time by a simple process using a plating liquid, for example. Also, the stress of the diaphragm is controlled by setting processing conditions in executing the plating process, which can prevent the stress from remaining inside, to form the diaphragm which vibrates faithfully to sound pressure signals. As a result, even small sound vibrations can be faithfully detected.

According to the present invention, by using the sputtering or vacuum vapor deposition technique, the metal film may be made of one of Si, Al, Ti, Ni, Mo, W, Au and Cu, or formed by laminating a plurality of materials selected from Si, Al, Ti, Ni, Mo, W, Au and Cu, thereby to constitute the diaphragm.

With this construction, the diaphragm can be formed by sputtering or vacuum vapor deposition using required metal materials. More particularly, the sputtering or vacuum vapor deposition technique can form the metal film without taking chemical properties into consideration such as ionization tendency unlike in the case of the metal film formed by plating technique using a plating liquid. Thus, the diaphragm can be formed by using either one material or a plurality of materials selected from Si, Al, Ti, Ni, Mo, W, Au and Cu as appropriate. As a result, it is possible to use any metal materials corresponding to the number of vibrations and volume of sound to be detected in order to form the diaphragm.

According to the present invention, the diaphragm may be formed of a lamination consisting of a base layer made of an organic film(s) using one of a resist, polyimide resin and polyparaxylene resin, and a conductive layer(s) made of a conductive material.

With this construction, since the diaphragm is formed of the lamination consisting of the base layer made of the organic film and the conductive layer made of the conductive material, the diaphragm can be formed by utilizing the flexibility of the resin material and the conductivity of the conductive material. More particularly, since it is only necessary to make the conductive material act as an electrode in forming the diaphragm, the diaphragm can be formed mainly of the resin material having strength and flexibility greater than the metal film. Particularly, these resin materials can relatively easily achieve coating with the thickness being controlled, and thus, a thin diaphragm as a whole can be formed. Consequently, the thickness is easily reduced compared with the diaphragm made of metal materials only, which allows sound pressure signals to be faithfully detected.

According to the present invention, the organic film of the sacrificial layer may use one of a resist and polyimide resin for forming a void area between the back electrode and the diaphragm by etching the sacrificial layer.

With this construction, the organic film is used as the sacrificial layer and formed on the silicon substrate to have a desirable thickness relatively easily. The sacrificial layer is formed between the back electrode and the diaphragm in the form of lamination and is etched to form the void area between the back electrode and the diaphragm. As a result, it becomes possible to easily form a space having a required height between the back electrode and the diaphragm by using the sacrificial layer.

According to the present invention, the substrate may be made of a monocrystal silicon substrate, and a silicon substrate of (100) orientation may be used as the monocrystal silicon substrate.

With this construction, it is possible to advance the etching selectively in a direction of an orientation peculiar to the silicon substrate of (100) orientation, which allows a precise etching faithful to an etching pattern. As a result, the process for providing any required shape can be realized.

According to the present invention, as a base for the sacrificial layer, a material having resistance to anisotropic etching may be used.

With this construction, by using the material having resistance to anisotropic etching, the process can be executed without damaging the organic film forming the sacrificial layer and the back electrode formed on the silicon substrate. As a result, a required process can be executed while protecting the back electrode.

According to the present invention, the sacrificial layer may have a thickness of 1 to 5 μm.

Here, the thickness of the sacrificial layer corresponds to the distance between the diaphragm and the back electrode. The sensitivity as the sound detecting mechanism increases as this distance decreases. However, the back electrode and diaphragm can contact to each other in a drying step in the process of etching the sacrificial layer as the distance between the diaphragm and the back electrode is reduced. Thus, it is effective to set the void area between the diaphragm and the back electrode to 1 to 5 μm in the present invention. As a result, good performance can be maintained by setting the thickness of the sacrificial layer.

According to the present invention, the diaphragm may be formed of a plated layer formed by plating technique, and an adhesion layer is disposed between the plated layer and an insulating layer formed on the substrate for enhancing adhesion.

With this construction, the adhesion between the plated layer and the insulating layer is improved by the adhesion layer disposed between the plating layer acting as the diaphragm and the insulating layer.

According to the present invention, an opening corresponding to a sound entrance may be formed by anisotropic etching after the back electrode is perforated to form the acoustic holes.

With this construction, yield of the process is improved. The controllability of the thickness of the back electrode is also improved by the process of the present invention. As a result, the back electrode with a required thickness is formed and yield is also improved.

According to the present invention, the thickness of the back electrode may be controlled by an inspection pattern juxtaposed to a sound detecting mechanism pattern on the silicon substrate.

With this construction, the thickness of the back electrode can be controlled by inspecting the inspection pattern juxtaposed to the sound detecting mechanism pattern on the silicon substrate. As a result, the thickness of the back electrode can be accurately controlled.

According to the present invention, the mechanism may comprise a signal fetching circuit formed on the substrate and having a plurality of semiconductor elements, a sound detecting section formed of the diaphragm and the back electrode, and an electric connecting member for transmitting signals from the sound detecting section to the signal fetching circuit.

With this construction, the electric connecting member is provided between the signal fetching circuit formed on the substrate and the sound detecting section consisting of the diaphragm and the back electrode, which allows signals from the sound detecting section to be processed in the signal fetching circuit. As a result, there is no need to provide any signal circuit apart from the sound detecting section, which can reduce the number of parts required for devices incorporating the sound detecting mechanism.

According to the present invention, the electric connecting member may be formed of metal wires or a metal film formed on the substrate in a semiconductor manufacturing process.

With this construction, the signal fetching circuit and the sound detecting mechanism are electrically connected by connection of the bonding technique or the like using metal wires, or by connection of the metal film formed on the substrate in the semiconductor manufacturing process. As a result, miniaturization of the mechanism becomes possible compared with a construction having wires connected by soldering.

BEST MODE FOR CARRYING OUT THE INVENTION

An embodiment of the present invention will be described hereinafter with reference to the drawings.

FIG. 1 is a sectional view of a silicon condenser microphone (simply referred to as a microphone hereinafter) exemplifying a sound detecting mechanism of the present invention. The microphone comprises a monocrystal silicon substrate A having a back electrode B formed in an area thereof, a diaphragm C in the form of a metal thin film opposed to the back electrode B, and a sacrificial layer arranged between the back electrode B and diaphragm C to act as a spacer D. This microphone allows the diaphragm C and the back electrode B to function as a capacitor, which is used to electrically take out variations of capacitance of the capacitor when the diaphragm C is vibrated by sound pressure signals.

The substrate A in this microphone has a size of a square with one side 5.5 mm in length and around 600 μm in thickness. The diaphragm C has a size of a square with one side 2 mm in length and around 2 μm in thickness. The back electrode B has 10 μm in thickness and has a plurality of perforations Ba formed therein corresponding to acoustic holes, each having a square with one side around 20 μm in length.

Specifically, a monocrystal silicon substrate 401 of (100) orientation is etched in part of a front surface thereof (lower side in FIG. 1), thereby to form acoustic holes (acting as the perforations Ba eventually) in the back electrode B. An acoustic opening E corresponding to a sound entrance is formed from a back surface (upper side in FIG. 1) of the monocrystal silicon substrate 401 in a portion corresponding to the acoustic holes. Also, a protective film 406 (second protective film), a sacrificial layer 407 made of an organic film and a metal film 408 are laminated on the front surface (lower side in FIG. 1) of the monocrystal silicon substrate 401. A portion corresponding to the back electrode B is etched to form a void area F between the back electrode B and the diaphragm C. The diaphragm C is formed by the metal film 408. Further, the spacer D is formed by the sacrificial layer 407 remaining at outer peripheral portions of the diaphragm C. A process for manufacturing the microphone will be described based on FIGS. 2 and 3.

Step (a): A first protective film 402 made of SiN is formed on the back surface (upper side in the drawings) of the monocrystal silicon substrate 401 to function as a masking material.

Step (b): An opening 403 is formed in the first protective film 402 made of SiN by photolithographic technique. Although not shown in the drawings, a resist pattern is formed on a surface of the first protective film 402 in forming the opening 403. Etching is executed by RIE (Reactive Ion Etching) technique, using the resist pattern as a mask, to remove the first protective film 402, thereby to form the opening 403. After executing this process, the unwanted resist pattern is removed by ashing.

Step (c): Next, an Au film acting as an electrode material is formed on the front surface by sputtering which allows the film to be formed in a low temperature process. Further, a resist pattern is formed on the surface of the Au film by photolithographic technique. Etching is executed using the resist pattern as a mask to form an electrode pad 404 from part of the Au film to have conductivity with the back electrode B. After executing this process, the unwanted resist pattern is removed by ashing. Further, in this step, a plurality of acoustic holes 405 (which are groove-like, instead of hole-like) communicating with the acoustic opening E are formed from the front surface by photolithographic technique. Although not shown in the drawings, in forming these acoustic holes 405, a resist pattern is formed on the front surface of the monocrystal silicon substrate 401 by photolithographic technique. The monocrystal silicon substrate 401 is etched to produce a required depth using the resist pattern as a mask. After this process, the unwanted resist pattern is removed by ashing. By forming the acoustic holes 405 in this way, these plural acoustic holes 405 act as the perforations Ba to communicate with the acoustic opening E after the acoustic opening E is formed by anisotropic etching in the step (f) described later.

Step (d): Next, a second protective film 406 is formed on the front surface of the substrate A to function as a material having resistance against the anisotropic etching using a water solution of TMAH (tetramethylammonium hydroxide) as an etching liquid in forming the acoustic opening E. The sacrificial layer 407 using either a photoresist (one example of resist) and a polyimide resin is formed by being laminated on a surface of the second protective film 406 (using the second protective film 406 as a base) to have a thickness of 1 to 51 μm.

Step (e): Next, in order to form the diaphragm C on the front surface, the metal film 408, e.g. Ni film, is formed on a front surface of the sacrificial layer 407 by sputtering to have a thickness of 2 μm. Then, a resist pattern is formed on a surface of the metal film 408 by photolithographic technique. Etching is executed, using the resist pattern as a mask, to remove the unwanted metal film 408. Further, after this process, the unwanted resist pattern is removed by ashing. Next, the sacrificial layer 407 and the second protective film 406 are etched, using the metal film 408 formed to the size of the diaphragm C as a mask, to allow the sacrificial layer 407 and the second protective film 406 disposed between the metal film 408 and the silicon substrate 401 to remain (in the region where the spacer D and the void area F are formed). The sacrificial layer 407 and the second protective film 406 present in other regions are removed.

In this step (e), the metal film 408 is formed by sputtering by using the Ni material. It is also possible to form the metal film 408 by utilizing a vacuum vapor deposition technique or plating technique. Particularly, in sputtering or vacuum vapor deposition, either one of Si, Al, Ti, Ni, Mo, W, Au and Cu may be used as a metal material, or a laminated film consisting of more than one of these metal materials may be used.

Further, in forming the metal film 408 in this step (e), Cr or Ti may be formed on the front surface of the sacrificial layer 407 as a adhesion layer by vacuum vapor deposition technique, thereby to form the metal film 408 on a front surface of the adhesion layer by sputtering using the Ni material or the like in the same way as in the above-described step. Also, it is possible to form a seed layer on the front surface of the sacrificial layer 407 (one example of insulating layer) using the same metal material as used in plating, thereby to form the metal film 408 (plated layer) on a front surface of the seed layer by plating technique.

Step (f): Next, anisotropic etching is executed using the water solution of TMAH (tetramethylammonium hydroxide) as an etching liquid and using the fist protective film 402 as a mask, which has the opening 403 formed therein in the step (b), thereby to form the acoustic opening E corresponding to the sound entrance. It is necessary to use, in this step, a protective film having resistance against anisotropic etching on the front surface, whereby a pre-treatment is executed so that the materials including the substrate A may not be etched by the etching liquid in the front surface (not shown). After executing the anisotropic etching process, such a protective film is no longer necessary and thus removed by a remover of exclusive use.

Step (g): Next, an RIE treatment is executed from the back surface to remove the first protective film 402 and part of the second protective film 406.

Step (h): Next, the sacrificial layer 407 is etched from the back surface by a sacrificial layer remover and plasma treatment through the perforations Ba corresponding to the plurality of acoustic holes 405, which allows part of the sacrificial layer 407 to remain at the outer peripheral portions of the back electrode B and the diaphragm C to act as the spacer D and allows the void area F to be formed between the back electrode B and the diaphragm C, thereby to complete the microphone.

The microphone completed in this way may be fixed to a printed board or the like for use as the construction shown in FIG. 1. When it is fixed to the printed board, wiring is established by wire bonding between the electrode portion 404, the metal film portion conductive to the diaphragm C and terminals formed on the printed board.

With the microphone manufactured in the above-noted process, the step of forming the SiN film in the process of manufacturing the microphone and the step of forming an integrated circuit can be executed simultaneously or in parallel. Thus, as shown in FIG. 6, an integrated circuit G may be formed on the substrate A to act as a signal fetching circuit provided with semiconductor elements such as a J-FET or the like functioning as a sound detecting section, apart from the microphone. Wiring H consisting of metal film is formed between terminals of the integrated circuit G, the electrode portion (not shown) conductive to the back electrode B and the metal film 408 to act as an electric connecting device. Thus, it is possible to provide a microphone having the function of directly converting sound pressure signals into electric signals for output. The wiring H has the metal film formed by plating technique or vacuum vapor deposition technique using the metal materials such as Au, Cu, Al or the like and etched to remove unwanted parts therefrom. Instead of the wiring H consisting of metal film, the electric connecting member may be formed by bonding wires. The microphone may be miniaturized when the integrated circuit G is formed on the same substrate A in this way. Further, it is possible to establish a step for executing heat treatment at high temperature as required for forming the microphone and the integrated circuit only in the first half of the manufacturing process, while establishing a step for forming the integrated circuit and the microphone treated at low temperature in the second half of the manufacturing process. As a result, it is possible to eliminate the influence of the heat treatment on the integrated circuit to overcome the influence of the heat treatment on the integrated circuit. Further, stress variations by heat history on the diaphragm C may be overcome.

According to the present invention, a selected depth realized by etching the substrate A corresponds to the acoustic holes, and the acoustic holes 405 are formed as the perforations Ba by anisotropic etching from the back surface, which allows the back electrode B to be formed by a relatively simple process. Further, the diaphragm C requiring thickness control is formed by sputtering, vacuum vapor deposition or plating technique, which allows the diaphragm C easily to have a thickness optimal for vibrations by a relatively simple process, thereby to detect sound pressure signals with high sensitivity. Also, since the void area F is formed between the back electrode B and the diaphragm C by etching the sacrificial layer 407, the thickness of the sacrificial layer 407 is controlled to set the distance between the back electrode B and the diaphragm C to a desired value. Moreover, it is realized that part of the sacrificial layer 407 is allowed to remain after having undergone etching to be used as the spacer D for maintaining the gap between the back electrode B and the diaphragm C. Particularly, the integrated circuit is formed on the substrate A to act as the sound detecting section, which can avoid the necessity of forming any special circuit for sound detection outside the sound detecting mechanism to reduce the number of parts of the entire apparatus when it is incorporated in the apparatus.

As described above, the sound detecting mechanism according to the present invention employs the construction including the back electrode B and the diaphragm C formed on the substrate by utilizing micro fabrication technique. As a result, the entire sound detecting mechanism may be made very compact and readily incorporated to small devices such as mobile phones. Moreover, it is capable of enduring reflow treatment at high temperature when it is mounted on a printed board, which makes it easy to assemble the apparatus.

Modified Embodiments

Apart from the above-described embodiment, the present invention may be implemented as follows, for example (common reference numbers and signs being used for the components in the following modified embodiments that have the same functions as in the foregoing embodiment).

(1) It is possible to form an Ni film or Cu film by utilizing the plating technique in forming the metal film 408. More particularly, after forming the electrode terminal 404, a seed layer made of the same material as a plating material is formed by sputtering and then an Ni film or Cu film is formed on an entire surface of the layer by a plating liquid to act as the metal film 408. The metal film (plated layer) 408 formed in this way functions as the diaphragm C by removing the unwanted parts thereof after executing anisotropic etching or the like. Further, in plating the film, it is possible to form the metal film made of Cr or Ti as a adhesion layer by vacuum vapor deposition technique or the like thereby to enhance the adhesion between the metal film 408 forming the diaphragm C and the organic film acting as the sacrificial layer 407 (one example of insulating layer).

In executing the plating treatment in particular, the stress control for the diaphragm can be easily carried out by adding impurities to the plating liquid and controlling pH value. Specifically, as shown in FIG. 4 in graphic representation, a relationship is established between amount of phosphorus contained in the plating liquid (phosphorus content/wt %) and internal stress of the metal film formed by plating. As apparent from the graph, it is possible to realize the diaphragm C with an extremely small internal stress by using an electroless Ni plating liquid with a phosphorus content of 10 to 12 wt % and by treating the film at the liquid temperature of 91° C. The diaphragm C with the internal stress being set to the extremely small value may vibrate faithfully to sound pressure signals to realize high sensitivity.

(2) As shown in FIG. 5, the diaphragm C may have a laminated construction consisting of a base layer 420 made of an organic film using one of polyimide resin, polyparaxylene resin (palylene resin; product name) and a photoresist film used in etching, and metal films 408 acting as conductive layers to hold the base layer therebetween. In a concrete example, a metal film 408 made of Ni or the like is formed on an outer surface of a sacrificial layer 407 by sputtering, and polyimide resin is applied on the film. After baking treatment, another metal film 408 made of Ni or the like is formed again by sputtering. Unwanted parts of the laminated film consisting of the metal films and polyimide resin are removed after executing anisotropic etching, and the sacrificial layer 407 is removed by an organic remover, thereby to obtain the diaphragm C with the laminated construction having the base layer 420 and the conductive layers (metal films 408). Having resistance against anisotropic etching, the Ni film is capable of acting as a protective film in anisotropic etching. Moreover, since the thickness of the laminated film consisting of polyimide resin and the Ni films represents the thickness of the diaphragm C, the diaphragm C may be formed with high accuracy. Further, it is possible to use a resist or polyparaxyline resin as the base layer 420 for forming the diaphragm C.

(3) The thickness of the back electrode B can be controlled by an inspection pattern juxtaposed to a sound detecting mechanism pattern on the silicon substrate. More particularly, a pattern of an opening diameter smaller than the diameter of the back electrode is provided on an inspection area, whereby the back electrode is etched only to a depth smaller than a desired thickness by the micro-loading effect of etching in the process of forming the acoustic holes. Such an arrangement of the patterns different in depth allows control of the thickness of the back electrode utilizing a phenomenon in which the patterns different in depth will perforate the electrode as time elapses in anisotropic etching.

INDUSTRIAL UTILITY

The sound detecting mechanism according to the present invention may be used as a condenser microphone, and besides as a sensor responsive to variations in aerial vibration and air pressure.

DESCRIPTION OF THE REFERENCE SIGNS

Figure 1:
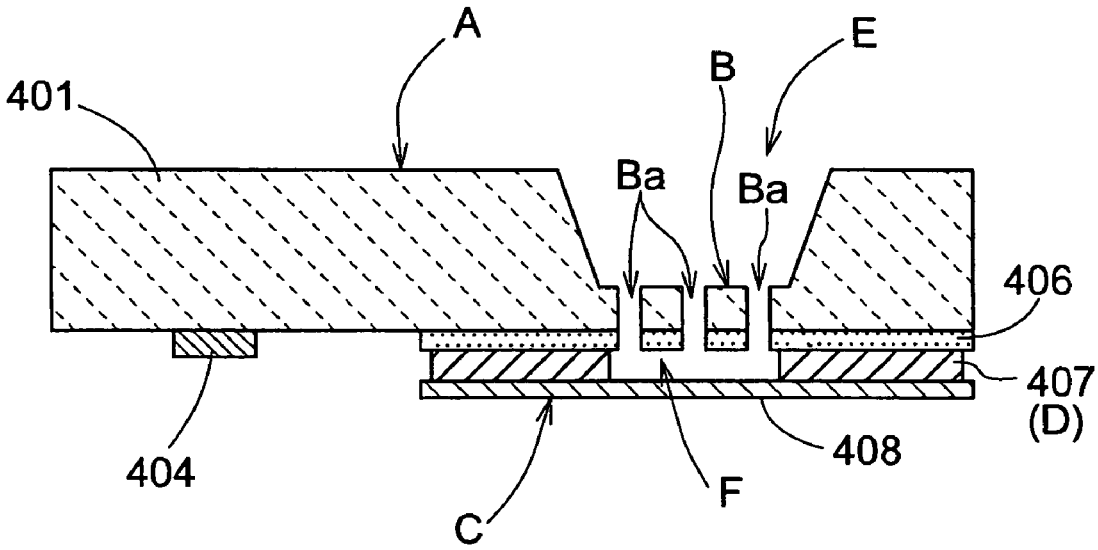
FIG. 1 A sectional view of a condenser microphone.
Figure 2:
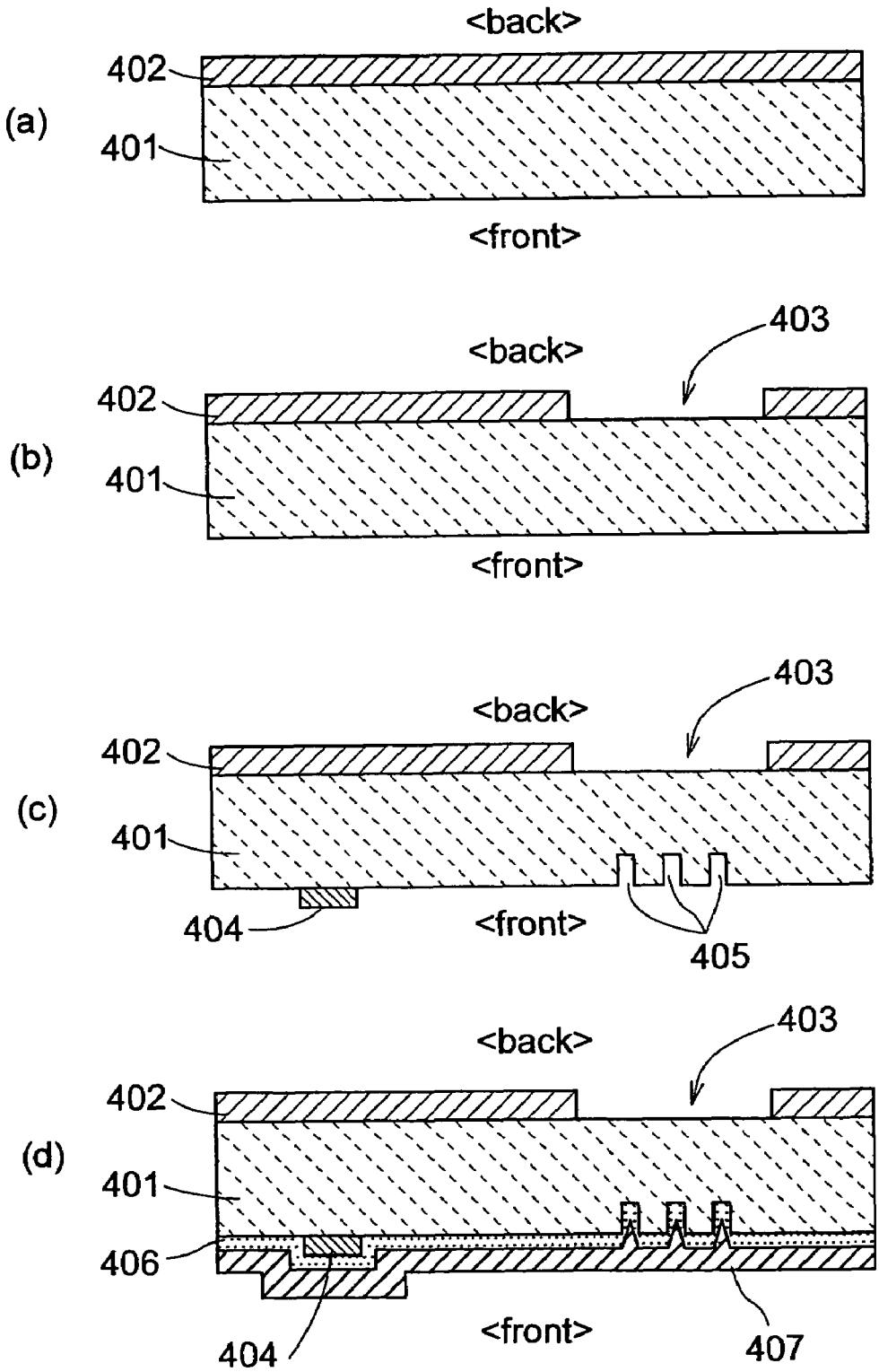
FIG. 2 Views consecutively showing steps for manufacturing the condenser microphone.
Figure 3:
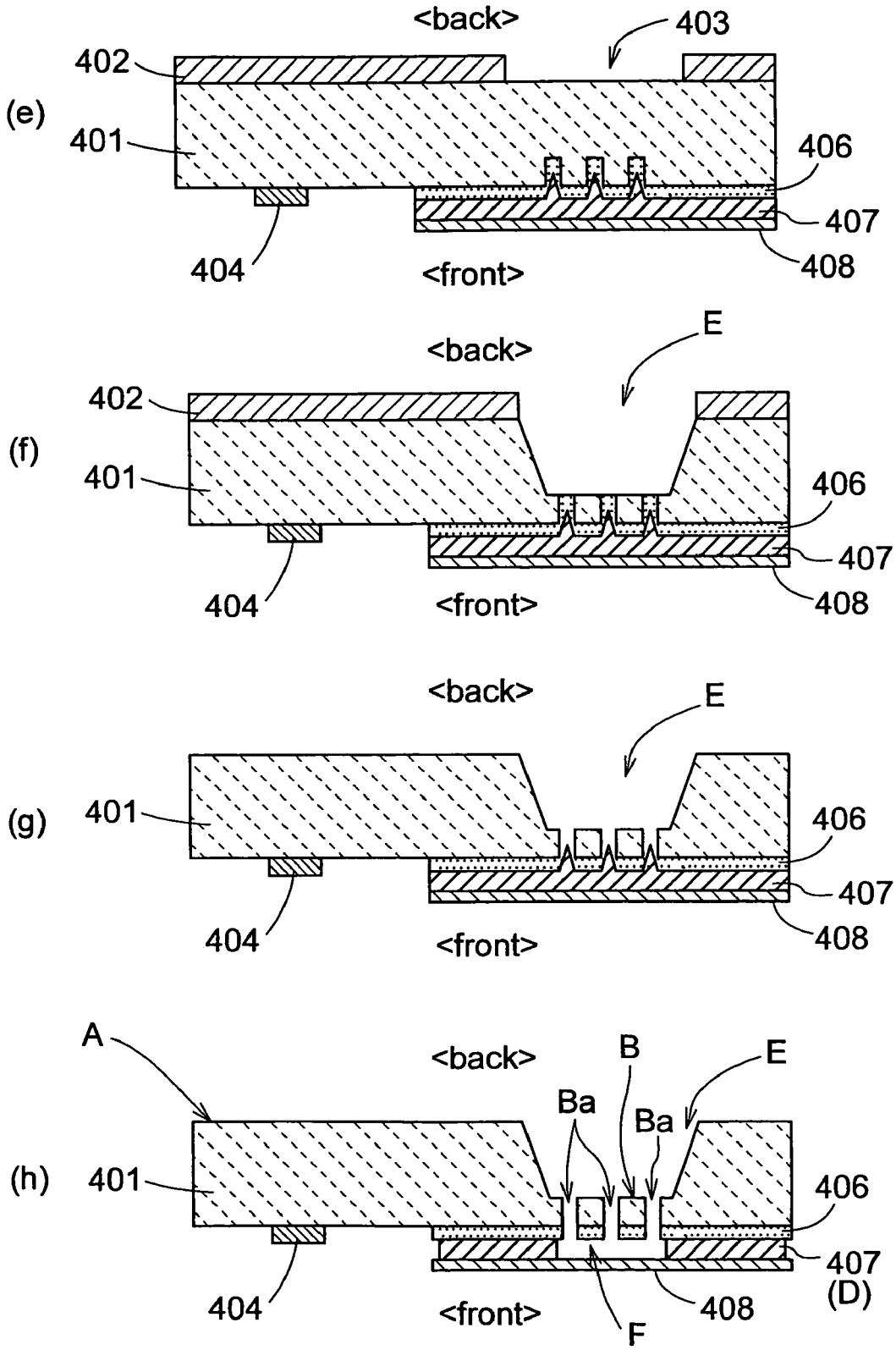
FIG. 3 Views consecutively showing steps for manufacturing the condenser microphone.
Figure 4:
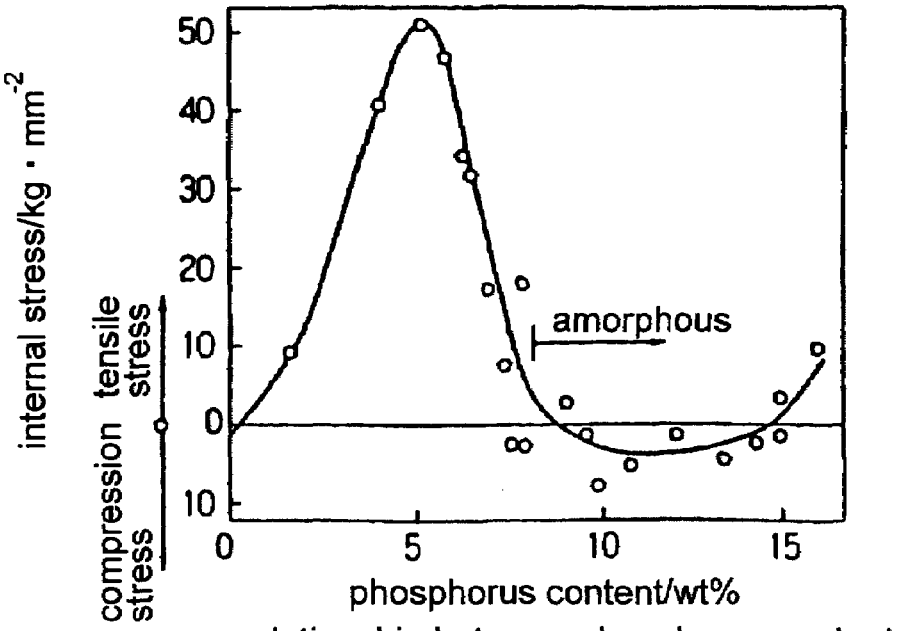
FIG. 4 A graphic representation showing a relationship between phosphorus content in a plating liquid and stress of a diaphragm in modified embodiment (1).
Figure 5:
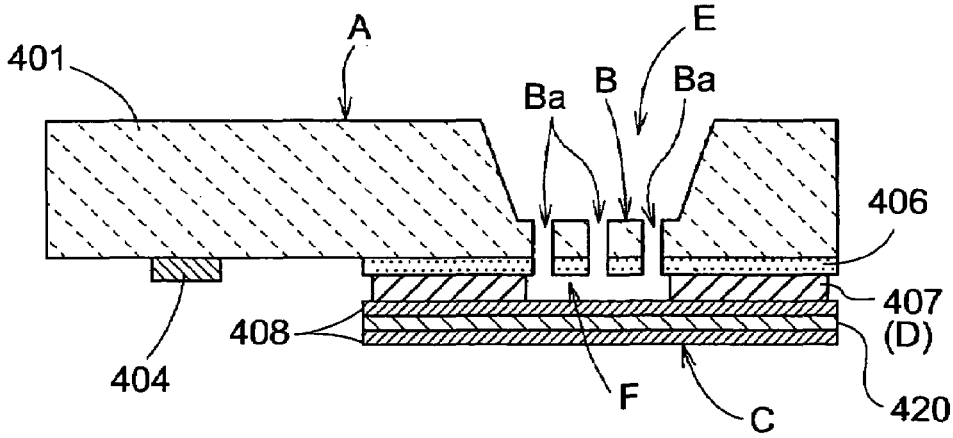
FIG. 5 A view showing a condenser microphone in modified embodiment (2).
Figure 6:
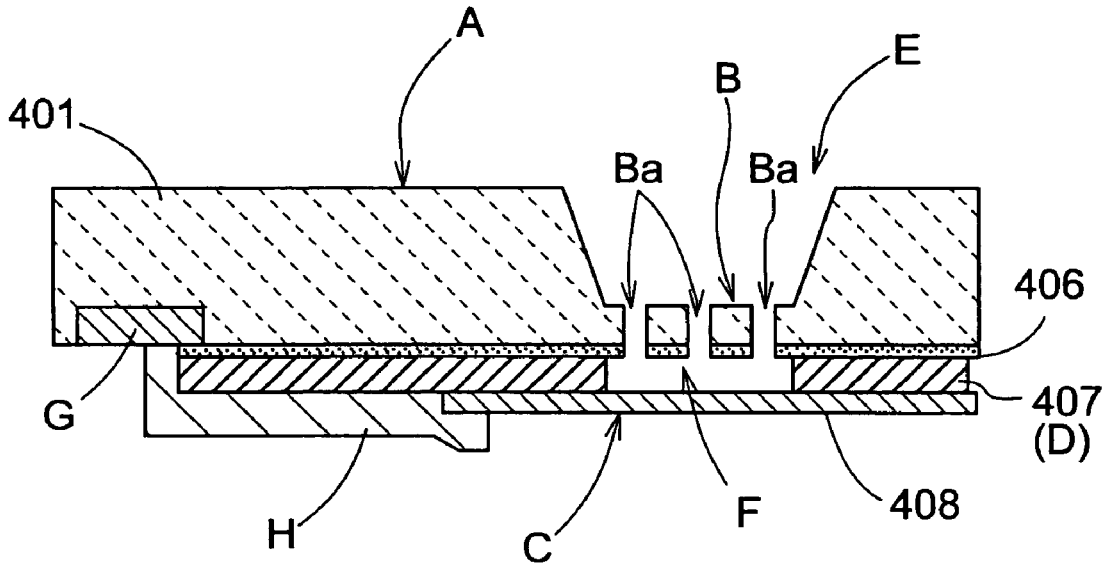
FIG. 6 A view showing a condenser microphone having a signal fetching circuit.
Figure 7:
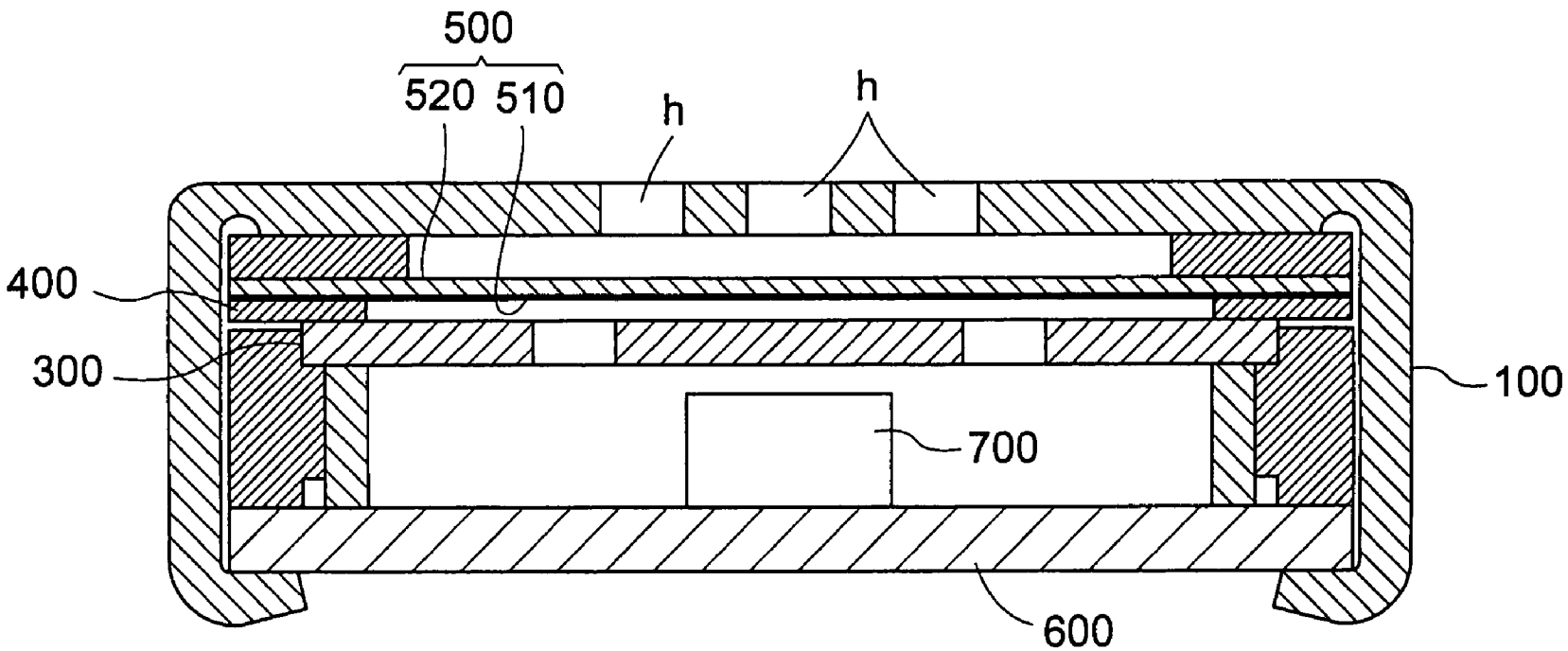
FIG.7 PRIOR ART
FIG. 7 A sectional view of a conventional condenser microphone.

407 sacrificial layer
408 metal film

420 base layer
A substrate
B back electrode
Ba perforations
C diaphragm
D spacer
F void area
H electric connecting member
G signal fetching circuit

The invention claimed is:

1. A sound detecting mechanism comprising a pair of electrodes forming a capacitor on a substrate in which one of the electrodes is a back electrode forming perforations therein corresponding to acoustic holes and the other of the electrodes is a diaphragm, wherein the diaphragm is made of at least one of a metal film and a laminated film, the metal film being formed by at least one of sputtering in a low temperature process, vacuum vapor deposition and plating technique, the laminated film being formed of an organic film, a conductive film, or any combination thereof, the back electrode is formed on the substrate, a spacer is formed from part of a sacrificial layer comprising an organic film for determining a distance between the diaphragm and the back electrode, and wherein, the metal film is made of at least one of Si, Al, Ti, Ni, Mo, W, Au and Cu, by using the at least one of the sputtering process and the vacuum vapor deposition, or formed by laminating a plurality of materials selected from the group consisting of Si, Al, Ti, Ni, Mo, W, Au and Cu, thereby constituting the diaphragm.

2. A sound detecting mechanism comprising a pair of electrodes forming a capacitor on a substrate in which one of the electrodes is a back electrode forming perforations therein corresponding to acoustic holes and the other of the electrodes is a diaphragm, wherein the diaphragm is made of at least one of a metal film and a laminated film, the metal film being formed by at least one of sputtering in a low temperature process, vacuum vapor deposition and plating technique, the laminated film being formed of an organic film, a conductive film, or any combination thereof, the back electrode is formed on the substrate, a spacer is formed from part of a sacrificial layer comprising an organic film for determining a distance between the diaphragm and the back electrode, and wherein a material having resistance to anisotropic etching is used as a base for the sacrificial layer.

3. A sound detecting mechanism comprising a pair of electrodes forming a capacitor on a substrate in which one of the electrodes is a back electrode forming perforations therein corresponding to acoustic holes and the other of the electrodes is a diaphragm, wherein the diaphragm is made of at least one of a metal film and a laminated film, the metal film being formed by at least one of sputtering in a low temperature process, vacuum vapor deposition and plating technique, the laminated film being formed of an organic film, a conductive film, or any combination thereof, the back electrode is formed on the substrate, a spacer is formed from part of a sacrificial layer comprising an organic film for determining a distance between the diaphragm and the back electrode, and wherein the diaphragm is formed of a plated layer formed by plating technique, and an adhesion layer is disposed between the plated layer and an insulating layer formed on the substrate for enhancing adhesion.

4. A sound detecting mechanism comprising a pair of electrodes forming a capacitor on a substrate in which one of the electrodes is a back electrode forming perforations therein corresponding to acoustic holes and the other of the electrodes is a diaphragm, wherein the diaphragm is made of at least one of a metal film and a laminated film, the metal film being formed by at least one of sputtering in a low temperature process, vacuum vapor deposition and plating technique, the laminated film being formed of an organic film, a conductive film, or any combination thereof, the back electrode is formed on the substrate, a spacer is formed from part of a sacrificial layer comprising an organic film for determining a distance between the diaphragm and the back electrode, and wherein the thickness of the back electrode is controlled by an inspection pattern juxtaposed to a sound detecting mechanism pattern on the substrate.

* * * * *